US007556475B2

(12) United States Patent
Roberts, III et al.

(10) Patent No.: US 7,556,475 B2
(45) Date of Patent: Jul. 7, 2009

(54) METHODS AND APPARATUS FOR ASSEMBLING TURBINE ENGINES

(75) Inventors: Herbert Chidsey Roberts, III, Simpsonville, SC (US); Kevin Leon Bruce, Greer, SC (US); Gerald Kent Blow, Greer, SC (US); Ronald Ralph Cairo, Greer, SC (US)

(73) Assignee: General Electric Company, Schenectady, NY (US)

( * ) Notice: Subject to any disclaimer, the term of this patent is extended or adjusted under 35 U.S.C. 154(b) by 380 days.

(21) Appl. No.: 11/443,723

(22) Filed: May 31, 2006

(65) Prior Publication Data

US 2007/0280820 A1 Dec. 6, 2007

(51) Int. Cl.
*F01D 11/08* (2006.01)

(52) U.S. Cl. ..... 415/173.1; 415/213.1; 29/889.2

(58) Field of Classification Search ..... 29/889.2; 415/173.1, 173.4, 173.5, 174.4, 174.5
See application file for complete search history.

(56) References Cited

U.S. PATENT DOCUMENTS 5,267,828 A * 12/1993 Lenhart et al. ..... 415/9
5,632,600 A 5/1997 Hull
6,340,286 B1 * 1/2002 Aksit et al. ..... 415/173.3
6,431,820 B1 8/2002 Beacock et al.
6,702,550 B2 3/2004 Darkins, Jr. et al.
6,758,653 B2 7/2004 Morrison
6,827,254 B2 12/2004 Hasz et al.
6,893,214 B2 5/2005 Alford et al.
6,932,566 B2 8/2005 Suzumura et al.
7,044,709 B2 5/2006 Bruce et al.
7,278,820 B2 * 10/2007 Keller ..... 415/173.1
2003/0133790 A1 7/2003 Darkins, Jr. et al.

* cited by examiner

*Primary Examiner*—Ninh H Nguyen
(74) *Attorney, Agent, or Firm*—Armstrong Teasdale LLP

(57) ABSTRACT

A method facilitates the assembly of a turbine engine. The method includes providing a shroud support block having a forward end and an aft end, coupling a forward end of a shroud to the shroud support block using a forward fastener, and coupling an aft end of the shroud to the shroud support block using an aft fastener. The method also includes installing a locking pin through the aft fastener to retain the aft fastener, and staking the locking pin in the shroud support block, such that the locking pin is securely coupled to the shroud support block.

17 Claims, 6 Drawing Sheets

METHODS AND APPARATUS FOR ASSEMBLING TURBINE ENGINES

BACKGROUND OF THE INVENTION

This invention relates generally to turbine engines and, more particularly, to methods and apparatus for assembling ceramic matrix composite (CMC) components.

At least some known turbine engines include at least one stator assembly and at least one rotor assembly that includes at least one row of circumferentially-spaced rotor blades. The blades extend radially outward from a platform to a tip. A plurality of static shrouds coupled to a stator block abut together to form flowpath casing that extends substantially circumferentially around the rotor blade assembly, such that a radial tip clearance is defined between each respective rotor blade tip and the flowpath casing. Ideally, minimizing the tip clearance facilitates improving turbine performance, but the clearance must still be sized large enough to facilitate rub-free engine operation through the range of available engine operating conditions.

During turbine operation, flow leakage across the rotor blade tips may adversely affect the performance and/or stability of the rotor assembly. However, during operation, because the shrouds may be subjected to higher operating temperatures than the stator block, the shrouds may thermally expand at a different rate than the stator block or the fastener assemblies used to couple the shrouds to the stator block. More specifically, such differential thermal expansion may undesirably cause increased tip leakage as the operating temperature within the engine is increased. Over time, the heat transfer from the shrouds and/or the differential thermal expansion may also cause premature failure of the fastener assemblies.

Accordingly, to facilitate reducing tip leakage caused by differential thermal expansion, at least some known engines channel cooling flow past the shrouds and fastener assemblies. However, excessive cooling flow may adversely affect engine performance. To facilitate increasing the operating temperature of the engine, and thus facilitate improving engine performance, other known stator assemblies use shrouds and fastener assemblies fabricated from stronger and/or higher temperature capability materials. However, as hot gas path temperatures increase, known mechanical fasteners may still prematurely fail.

BRIEF DESCRIPTION OF THE INVENTION

In one aspect, a method for assembling a turbine engine is provided. The method includes providing a shroud support block having a forward end and an aft end, coupling a forward end of a shroud to the shroud support block using a forward fastener, and coupling an aft end of the shroud to the shroud support block using an aft fastener. The method also includes installing a locking pin through the aft fastener to retain the aft fastener, and staking the locking pin in the shroud support block, such that the locking pin is securely coupled to the shroud support block.

In another aspect, a fastening apparatus is provided for coupling a ceramic matrix composite (CMC) shroud to a shroud support block in a turbine engine. The shroud and the support block each have a forward flange and an aft flange. The fastening apparatus includes a forward fastener for coupling the forward flange of the shroud to the forward end of the shroud support block. An aft fastener couples the aft flange of the shroud to the aft end of the shroud support block. A locking member is configured to engage the shroud support block to retain the aft fastener in the shroud support block.

DETAILED DESCRIPTION OF THE INVENTION

Figure 1:
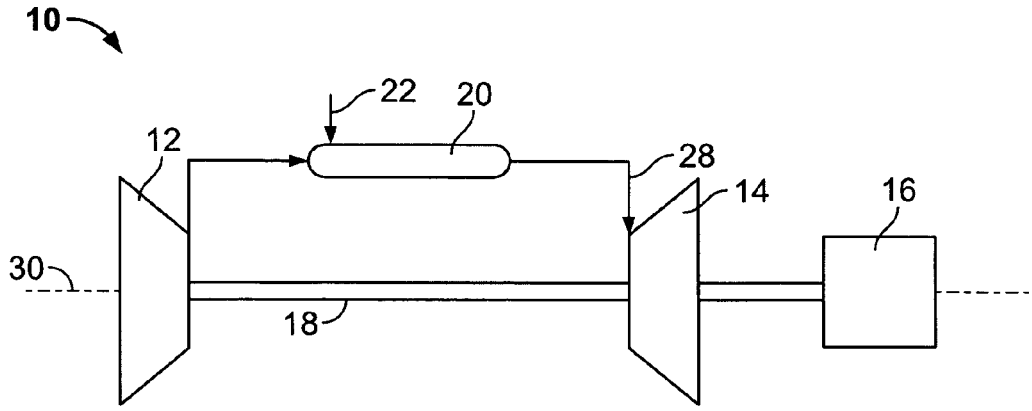
FIG. 1 is a schematic illustration of an exemplary turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single rotor or shaft 18. In an alternative embodiment, shaft 18 is segmented into a plurality of shaft segments, wherein each shaft segment is coupled to an adjacent shaft segment to form rotor shaft 18. Compressor 12 supplies compressed air to a combustor 20 wherein the air is mixed with fuel supplied via a stream 22. In one embodiment, engine 10 is a 7FA gas turbine engine commercially available from General Electric Company, Greenville, S.C.

In operation, air flows through compressor 12 and compressed air is supplied to combustor 20. Combustion gases 28 from combustor 20 propel turbine 14. Turbine 14 rotates rotor shaft 18, compressor 12, and electric generator 16 about a longitudinal axis 30.

Figure 2:
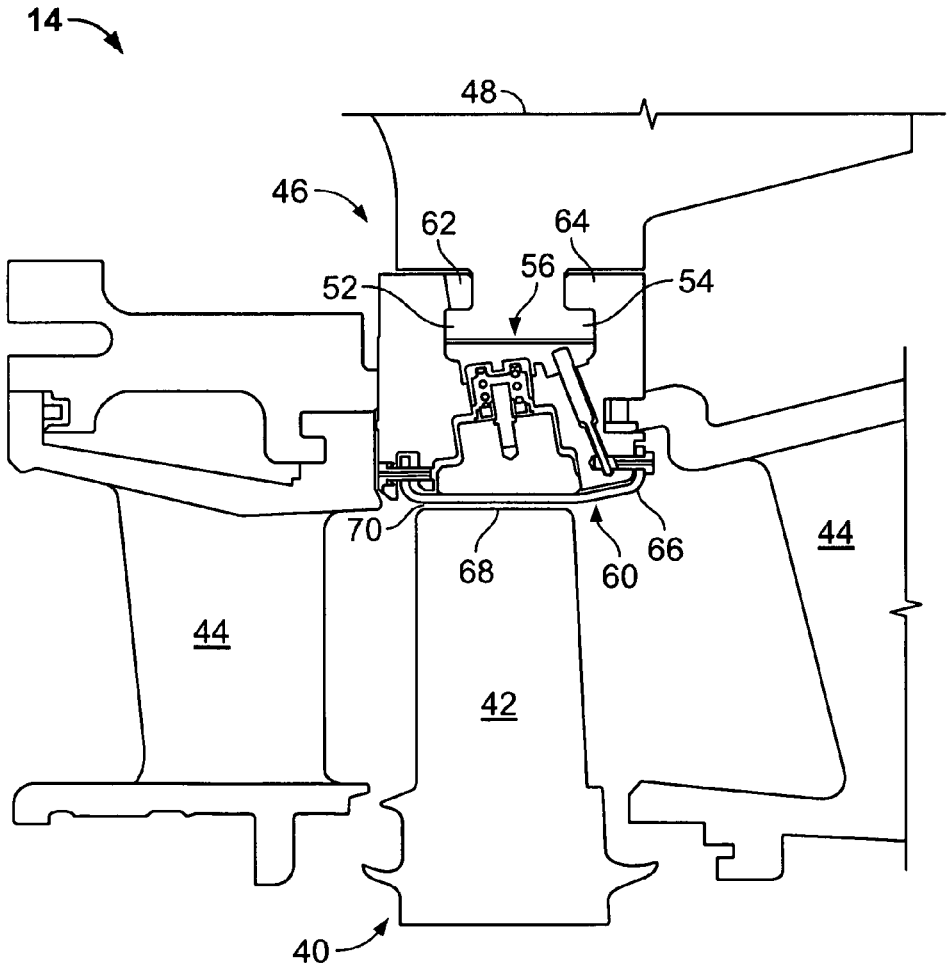
FIG. 2 is a schematic illustration of a portion of a high pressure turbine that may be used with the turbine engine shown in FIG. 1.

FIG. 2 is a schematic illustration of a portion of turbine 14. Turbine 14 includes a plurality of stages 40, each of which in the exemplary embodiment includes a rotating row of turbine blades 42 and a stationary row of stator vanes 44. Turbine blades 42 are supported by rotor disks (not shown) coupled to rotor shaft 18. A stator casing 46 extends circumferentially around turbine blades 42 and stator vanes 44, such that stator vanes 44 are supported by casing 46.

Casing 46 includes a case segment 48 positioned radially outward from turbine blades 42 of turbine stage 40. Case segment 48 includes a forward mounting hook 52 and an aft mounting hook 54 that define a shroud channel 56. Forward and aft case mounting hooks 52 and 54 support shroud assembly 60 mounted thereto. Specifically, in the exemplary embodiment, shroud assembly 60 includes forward and aft shroud mounting hooks 62 and 64, respectively, that are complementary to, and mate with, respective forward and aft case mounting hooks 52 and 54 when shroud assembly 60 is mounted thereto. Shroud assembly 60 also includes a shroud 66 that is radially outward of turbine blade tip 68 such that a tip clearance 70 is defined between shroud 66 and turbine blade tip 68. In an exemplary embodiment, shroud 66 is fabricated from a ceramic matrix composite (CMC) material.

Figure 3:
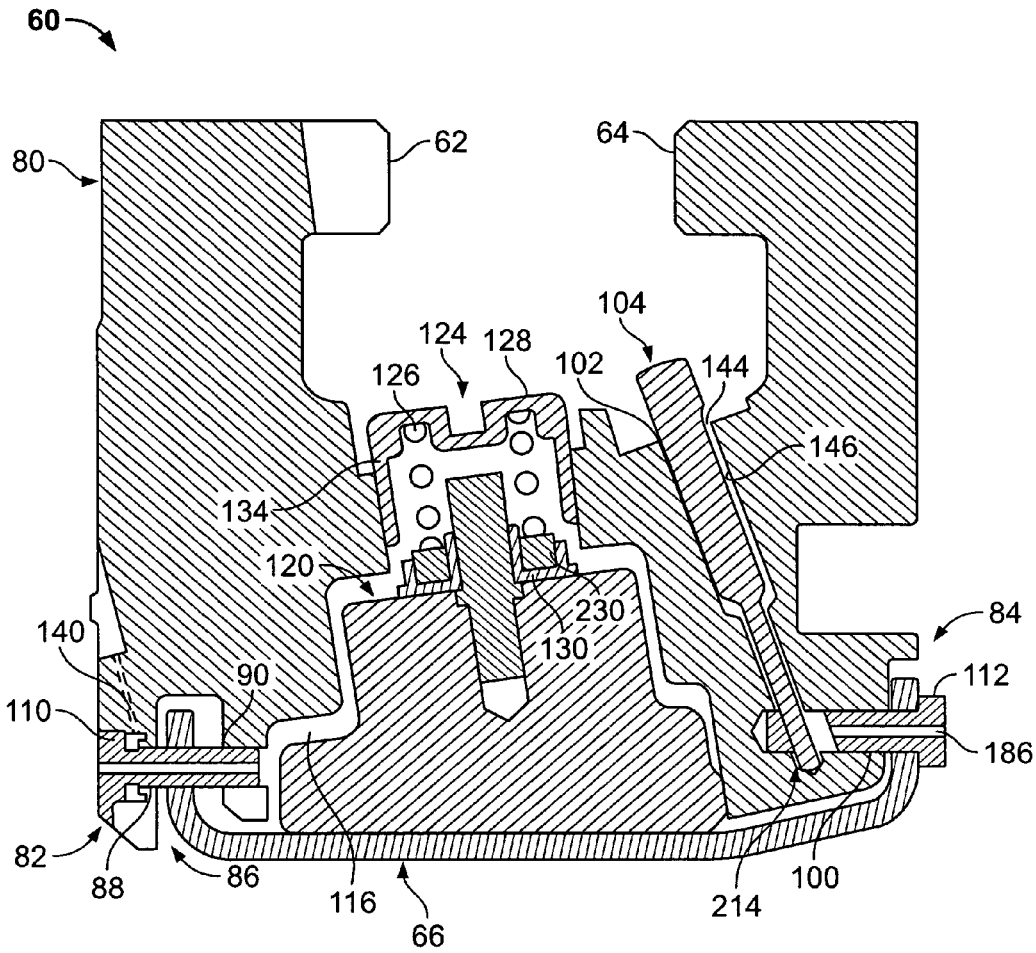
FIG. 3 is an enlarged cross sectional view of an exemplary shroud assembly that may be used with the turbine shown in FIG. 2.

FIG. 3 illustrates a cross sectional view of shroud assembly 60. Shroud assembly 60 includes a shroud support block 80. As described above, shroud hooks 62 and 64 are formed on shroud support block 80 to enable shroud assembly 60 to be coupled to case segment 48. Shroud support block 80 includes a forward end 82 and an aft end 84. Forward end 82 includes a lower slot 86 that extends generally transversely across the bottom of shroud support block 80. End 82, aligned pin support holes 88 and 90, respectively. Shroud support aft end 84 includes an aft mounting hole 100 and a channel 102. Channel 102 intersects aft mounting hole 100 and is sized to receive a locking member 104 therein. Shroud 66 is coupled to shroud support block 80 at forward end 82 via a plurality of forward fasteners 110, and is coupled to shroud support block 80 at aft end 84 with a plurality of aft fasteners 112. In an exemplary embodiment, forward and aft fasteners 110 and 112 are each attachment pins. Aft fastener 112 includes a ceramic coating that facilitates providing a wear surface for fastener-to-shroud interfaces.

Shroud support block 80 includes a centrally-located cavity 116 that houses a damper 120 therein. Damper 120 facilitates damping vibratory modes of shroud 66 and facilitates positive seating of shroud 66 in shroud support block 80, and each of which facilitates control of tip clearance 70 during operation of engine 10. A biasing mechanism 124 between shroud support block 80 and damper 120 facilitates inducing a pre-load on damper 120. In an exemplary embodiment, biasing mechanism 124 includes a spring 126, an upper spring seat 128, and a lower spring seat 130 that engages damper 120. Moreover, in the exemplary embodiment, upper spring seat 128 is inserted into a spring retention sleeve 134 which is, then seated into shroud support block 80. The pre-load provided by spring 126 is adjusted by rotating upper spring seat 128 within spring retention sleeve 134. In some embodiments, upper spring seat 128 may be inserted directly into shroud support block 80.

Shroud support block forward end 82 includes a cooling air passageway 140 that enables cooling air to be channeled forward and fastener 110 to facilitate controlling an operating temperature of forward fastener 110. A cooling air circuit, including a passageway 144 extending between locking member 104 and an interior wall 146 of locking member channel 102, is defined at shroud support block aft end 84. Passageway 144 enables cooling air to be channeled towards aft fastener 112.

Figure 4:
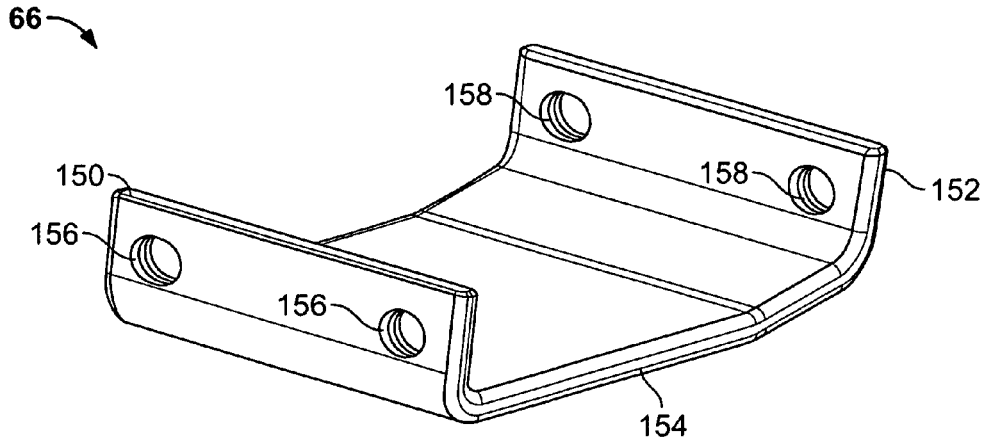
FIG. 4 is a perspective view of an exemplary shroud used with the shroud assembly shown in FIG. 3.

FIG. 4 illustrates a perspective view of shroud 66. In exemplary embodiment, shroud 66 is fabricated from a ceramic matrix composite (CMC) material that enables shroud 66 to withstand higher operating temperatures as well as temperature spikes/incursions that may be imposed on design operating temperatures. In the exemplary embodiment, shroud 66 includes a forward flange 150, an aft flange 152, and a web portion 154 extending therebetween. Forward flange 150 is sized to be received in shroud support slot 86 and includes a pair of mounting apertures 156. Apertures 156 are sized to receive forward fasteners 110 therein to facilitate coupling forward flange 150 to shroud support block 80. Aft flange 152 includes a pair of apertures 158 that are sized to receive aft fasteners 112 therein to facilitate coupling aft flange 152 to shroud support block 80.

Figure 5:
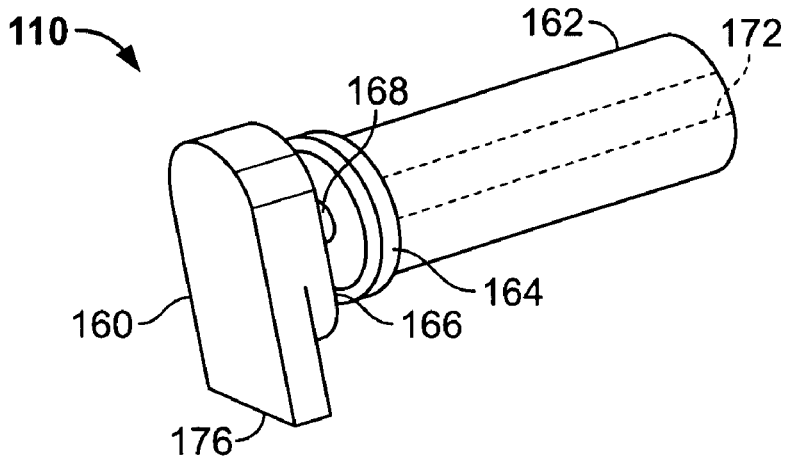
FIG. 5 is a perspective view of an exemplary forward fastener used with the shroud assembly shown in FIG. 3.
Figure 6:
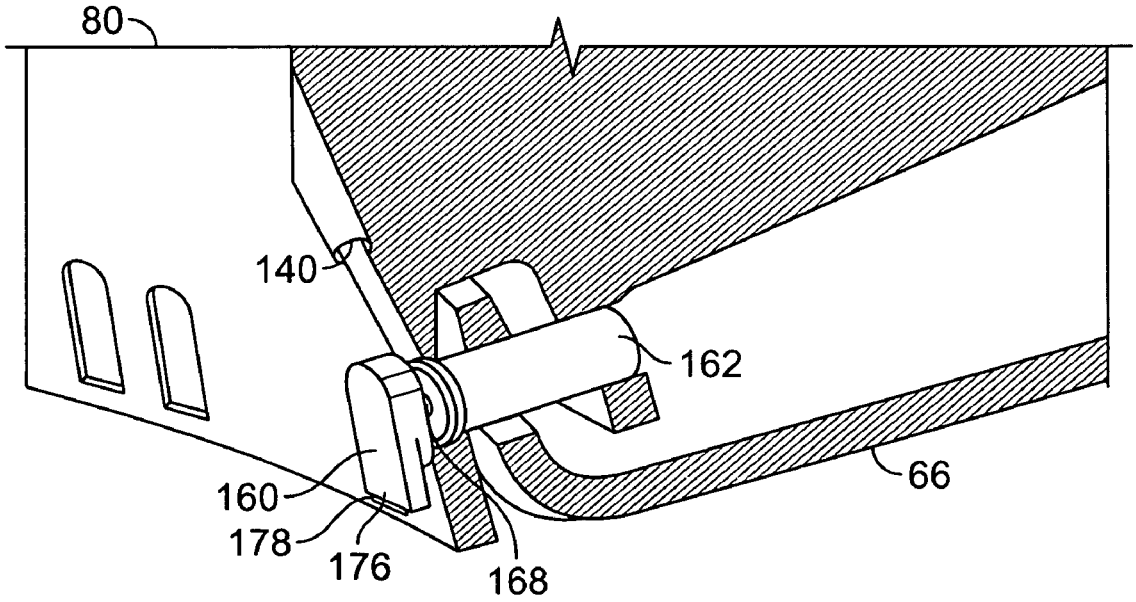
FIG. 6 is a fragmentary view of the fastener shown in FIG. 5 installed in a shroud support block used with the shroud assembly shown in FIG. 3.

FIG. 5 illustrates a perspective view of forward fastener 110. In the exemplary embodiment, fastener 110 includes a D-shaped head 160 and a cylindrically shaped body 162 that extends from a rim 164. A circumferential groove 166 is defined between D-shaped head 160 and rim 164. When shroud assembly 60 is fully assembled, groove 166 is coupled in communication with cooling air passageway 140 (shown in FIG. 3) and includes a cross-drilled hole 168 extending therethrough. In addition, hole 168 is positioned in flow communication with an air channel 172 extending axially through body 162 and with cooling air passageway 140 such that a cooling circuit is formed that enables cooling air to be channeled towards forward fastener 110. A pry lip 176 formed on D-shaped head 160 facilitates aid in disassembly. When forward fastener 110 is coupled within shroud support block 80, D-shaped head 160 is received in a recess 178 defined in shroud support block 80 that is sized and shaped to prevent rotation of forward fastener 110 within shroud support block 80.

Figure 7:
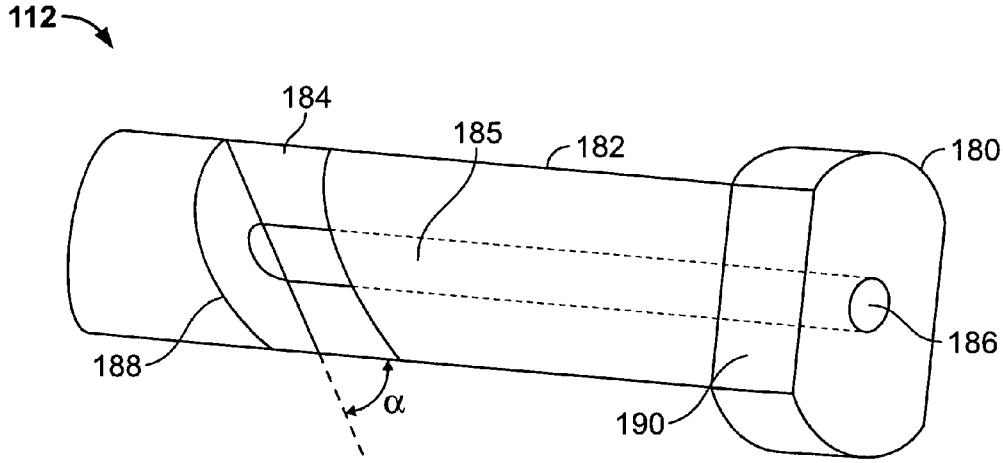
FIG. 7 is a perspective view of an exemplary aft fastener used with the shroud assembly shown in FIG. 3.

FIG. 7 illustrates a perspective view of aft fastener 112. Aft fastener 112 includes a head 180 and a body 182 that extends longitudinally from head 180. A relief cut 184 is formed in body 182 and a cooling air channel 185 extends from relief cut 184 to an exhaust outlet 186 formed in head 180. Relief cut 184 is formed at a draft angle a and has a forward edge 188. Head 180 includes a clocking feature 190 that facilitates orienting aft fastener 112 relative to shroud block aft mounting hole 100. In the exemplary embodiment, clocking feature 190 includes a plurality of flats formed on head 180.

Figure 8:
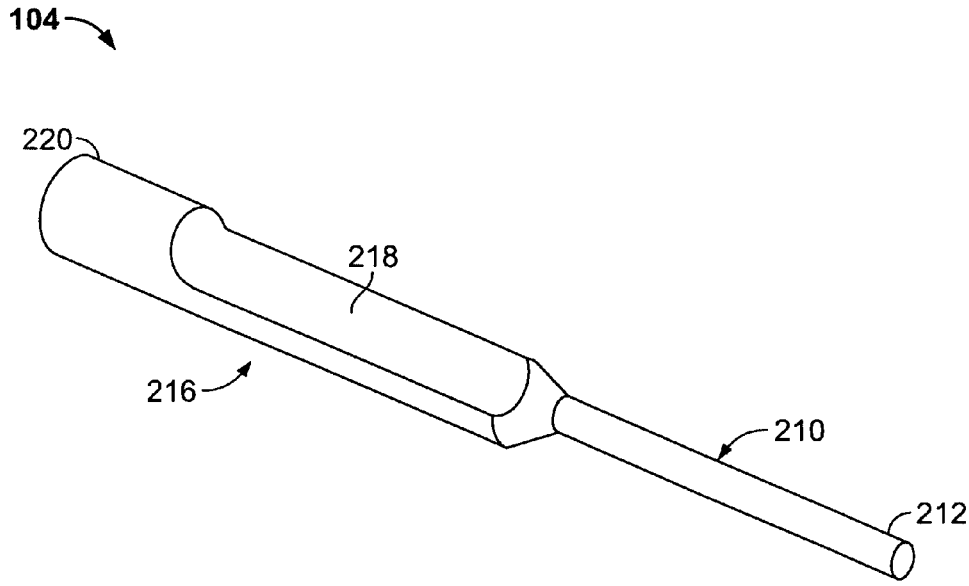
FIG. 8 is a perspective view of an exemplary locking pin used with the shroud assembly shown in FIG. 3.

FIG. 8 illustrates a perspective view of locking member 104. In the exemplary embodiment, locking member 104 is a locking pin that includes a mating end 210 having a mating tip 212. When shroud assembly 60 is fully assembled, mating tip 212 extends through aft fastener 112 and is received in a pocket 214 formed in shroud support block 80 (shown in FIG. 3). Locking member 104 also includes an intermediate section 216 including a relief cut 218 that facilitates the formation of cooling air passageway 144 when locking member 104 is coupled with in shroud support block 80. In the exemplary embodiment, a threaded end 220 extends from intermediate section 216 and facilitates disassembly of shroud assembly 60.

Figure 9:
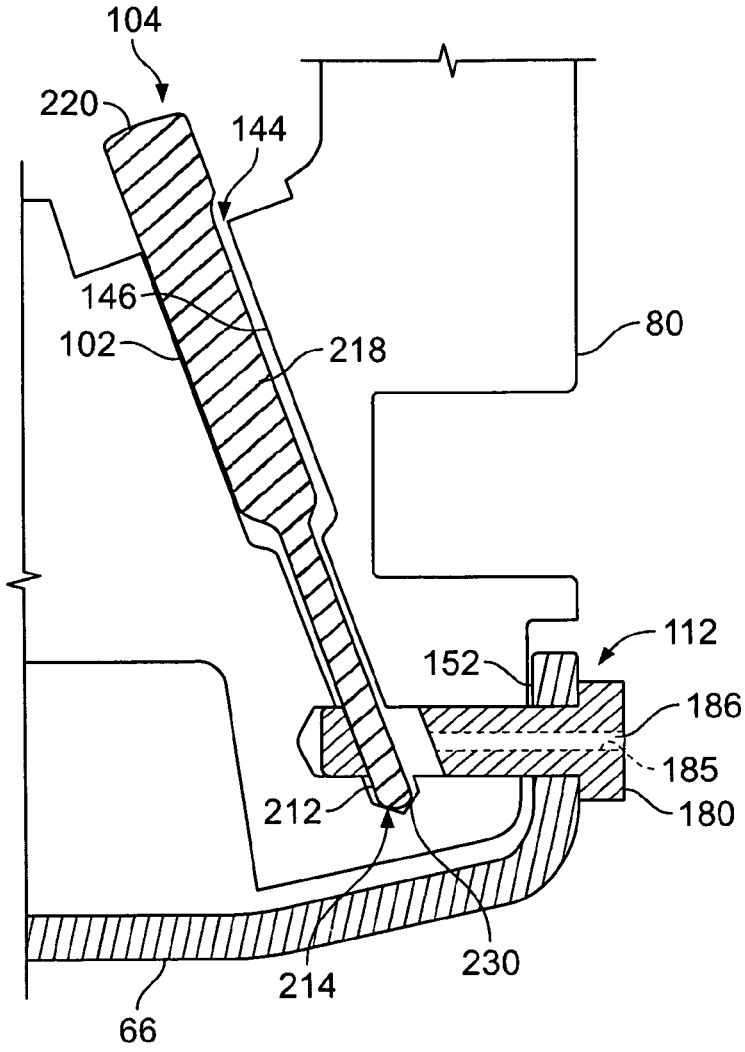
FIG. 9 is a fragmentary view of the aft fastener and locking member installed in a shroud support block.

FIG. 9 illustrates an enlarged view of aft fastener 112 and locking member 104 installed in shroud support block 80. Aft fastener 112 is oriented using clocking feature 190 such that relief cut 184 is substantially aligned with locking member channel 102. Locking member 104 is installed in channel 102 such that mating end 210 extends into relief cut 184. Draft angle $\alpha$ urges locking member mating tip 212 into pocket 214 with an interference fit. When locking member 104 is installed, passageway 144 extends between locking member relief cut 218 and the interior wall 146 of locking member channel 102. Passageway 144 forms a cooling circuit that enables cooling air be channeled towards aft fastener 112. Passageway 144 is positioned in flow communication with aft hole 100 and relief cut 184 such that cooling air may enter channel 185 at relief cut 184 and exhausts through outlet 186.

Shroud 66 is coupled to shroud support block 80 by first inserting damper 120 into shroud support block cavity 116. Shroud 66 is then positioned such that forward flange 150 is received in slot 86 such that apertures 156 are substantially aligned with pin support holes 88 and 90. Forward fasteners 110 are inserted through pin support holes 88 and 90 and apertures 156. Once forward fasteners 110 are installed, head 160 prevents rotation of forward fastener 110. Forward fastener 110 is then staked to provide positive retention and to prevent rotation or vibration during operation. As is known in the art, during staking, metal material is deformed around the fastener with a tool similar to a nail punch, such that the fastener is secured in position within the shroud support block.

Shroud aft flange 152 is positioned such that apertures 158 are substantially aligned with aft mounting holes 100, and aft fasteners 112 are installed. Once installed, each aft fastener 112 is oriented into position to receive locking member 104 using fastener head clocking feature 190. Locking member 104 is then installed. As locking member 104 is inserted into position, mating end 210 contacts aft fastener 112 such that locking member mating tip 212 is retained between relief cut forward edge 188 and shroud support block pocket 214. Once fully installed, locking member 104 exerts a nominal force on aft fastener 112 which causes shroud 66 to be pressed against shroud support block 80. Aft shroud flange 152 is compressed to facilitate minimizing leakage between shroud 66 and shroud support block 80. Locking member 104 is then secured in position to complete the assembly of shroud assembly 60. Threaded extension 220 of locking member 104 is left exposed for disassembly. Finally, biasing mechanism 124 is adjusted until a desired preload is induced to damper 120.

Figure 10:
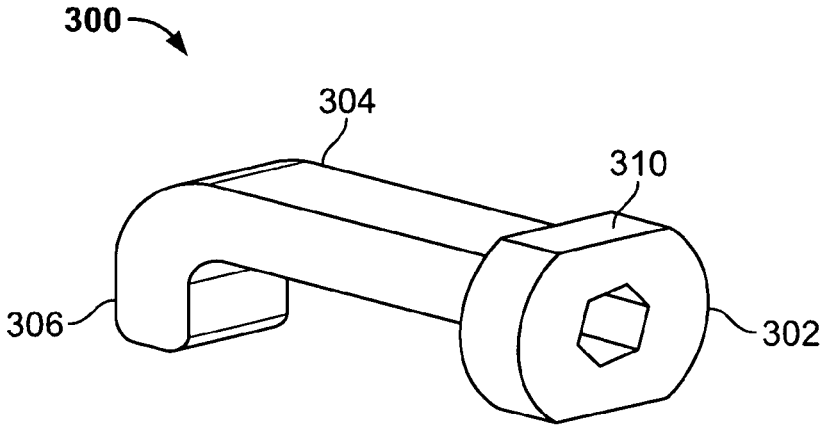
FIG. 10 is a perspective view of an alternative embodiment of an aft fastener that may be used with the shroud assembly shown in FIG. 3.
Figure 11:
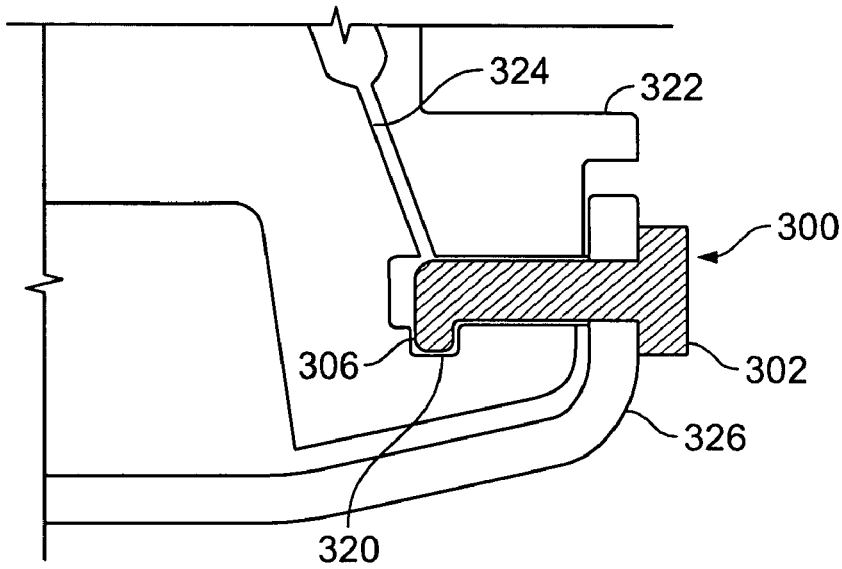
FIG. 11 is a cross-sectional view of the aft fastener of FIG. 10 installed in a shroud support block.

FIGS. 10 and 11 illustrate an alternative embodiment of an aft fastener 300 that may be used with shroud assembly 60. Fastener 300 includes a head 302 and a body 304 that has rectangular cross-sectional profile. A hook tip 306 is formed at an end of body 304 and flats 310 are formed on head 302. Fastener 300 is installed such that hook tip 306 is initially facing sidewards and is then rotated ninety degrees to interlock with a pocket 320 formed in a shroud support block 322. In the exemplary embodiment, fastener 300 utilizes a rectangular entry hole (not shown) that transitions into pocket 320 in a shroud support block 322. Hook tip 306 functions similarly to a locking member i.e., member 104 (shown in FIG. 9) by engaging pocket 320 to retain fastener 300 in shroud support block 322. A cooling circuit 324 is defined that enables cooling air to be channeled to fastener 300. For enhanced vibratory control, in some embodiments, a Belleville spring (not shown) is coupled under head 302 to induce an enhanced clamping force to shroud flange 326.

Figure 12:
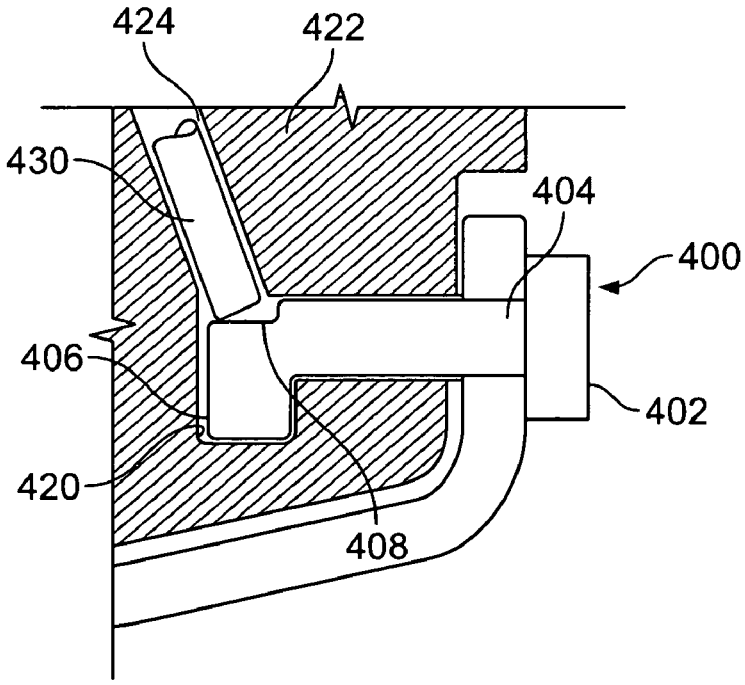
FIG. 12 is a cross-sectional view of another alternative embodiment of an aft fastener installed in a shroud support block.

FIG. 12 illustrates another alternative embodiment of an aft fastener 400 that may be used with shroud assembly 60. In the exemplary embodiment, fastener 400 has a head 402 and a body 404 that has substantially rectangular cross-sectional profile. Body 404 is formed with a hook tip 406 and a step 408 that is opposite hook tip 406 and is formed at an end of body 404. Flats (not shown) may also be formed on head 402. Fastener 400 utilizes a rectangular entry hole (not shown) that transitions into a pocket 420 defined in a shroud support block 422. Hook tip 406 functions similarly to a locking member by engaging pocket 420 to facilitate retaining fastener 400 in shroud support block 422. A cooling circuit 424 is defined that channels cooling air towards fastener 400. A separate locking member 430 may be used with fastener 400 to provide redundant retention of fastener 400 within shroud support block 422. When used, locking member 430 engages step 408 to facilitate retaining fastener 400 in shroud support block 422.

The above-described fastening apparatus provides a cost-effective and highly reliable method for coupling a ceramic matrix composite (CMC) shroud to a shroud support block in a turbine engine. The fastening apparatus enables the turbine to operate at higher temperatures, as well as, withstanding temperatures spikes such that a damage tolerant attachment system capable of meeting long term durability goals is provided. The fastening apparatus also facilitates improving long term reliability and maintainability of the turbine assembly and improving the operating efficiency of the gas turbine engine in a cost-effective and reliable manner.

Exemplary embodiments of a fastening apparatus for coupling a shroud to a shroud support block in a turbine engine are described above in detail. The apparatus is not limited to the specific embodiments described herein, but rather, components of the fastening apparatus may be utilized independently and separately from other components described herein. For example, the forward and aft fasteners may also be used in combination with other turbine engine components, and is not limited to practice with only CMC shroud assemblies as described herein. Rather, the present invention can be implemented and utilized in connection with many other high temperature attachment applications.

While the invention has been described in terms of various specific embodiments, those skilled in the art will recognize that the invention can be practiced with modification within the spirit and scope of the claims.

What is claimed is:

1. A method for assembling a turbine engine, said method comprising:

providing a shroud support block having a forward end and an aft end, wherein the shroud support block includes a transverse slot defined at the forward end of the support block;

coupling a shroud to the shroud support block by inserting a forward fastener through an aperture in a flange that extends from a forward end of the shroud, wherein the flange is inserted into the transverse slot;

coupling an aft end of the shroud to the shroud support block using an aft fastener;

installing a locking pin through the aft fastener to retain the aft fastener; and staking the locking pin in the shroud support block, such that the locking pin is securely coupled to the shroud support block.

2. A method in accordance with claim 1 wherein coupling a forward end of a shroud to the shroud support block comprises coupling the forward end of the shroud to the shroud support block using a forward fastener having a D-shaped head that is received in a recess defined in the shroud support block.

3. A method in accordance with claim 1 wherein coupling a forward end of a shroud to the shroud support block further comprises staking the forward fastener in the shroud support block.

4. A method in accordance with claim 1 wherein coupling a forward end of a shroud to the shroud support block further comprises coupling the forward end of the shroud to the shroud support block using a forward fastener having a cooling air channel defined therein.

5. A method in accordance with claim 1 wherein coupling an aft end of the shroud to the shroud support block using an aft fastener comprises coupling the aft end of the shroud to the shroud support block using an aft fastener including a ceramic coating.

6. A method in accordance with claim 1 wherein coupling an aft end of the shroud to the shroud support block comprises coupling the aft end of the shroud to the shroud support block using an aft fastener having a cooling air channel defined therein.

7. A method in accordance with claim 1 wherein coupling an aft end of the shroud to the shroud support block further comprises orienting the aft fastener using a clocking feature formed on a head of the aft fastener.

8. A method in accordance with claim 1 wherein installing a locking pin through the aft fastener comprises:

securing the locking pin in position relative to the aft fastener with an interference fit; and coupling the aft fastener to the aft end of the support block to facilitate retaining the shroud in position.

9. A fastening apparatus for coupling a ceramic matrix composite (CMC) shroud to a shroud support block in a turbine engine, wherein the shroud and the support block each include a forward end, said fastening apparatus comprising:

a forward fastener for coupling the forward end of the shroud to the forward end of the shroud support block;

an aft fastener for coupling the aft end of the shroud to the aft end of the shroud support block; and a locking member configured to engage the shroud support block to retain said aft fastener in the shroud support block, wherein said support block, said aft fastener, and said locking member define a cooling circuit for said aft fastener.

10. A fastening apparatus in accordance with claim 9 wherein said locking member comprises a locking pin.

11. A fastening apparatus in accordance with claim 10 wherein said locking pin extends through a relief cut formed in said aft fastener.

12. A fastening apparatus in accordance with claim 9 wherein said locking member comprises a hook tip formed on said aft fastener.

13. A fastening apparatus in accordance with claim 9 wherein said forward fastener comprises a D-shaped head that is received in a complimentary-shaped recess in the shroud support block.

14. A fastening apparatus in accordance with claim 9 wherein said forward fastener comprises a hole that is in flow communication with a cooling air channel extending axially through said forward fastener.

15. A fastening apparatus in accordance with claim 9 wherein said aft fastener comprises a head and a body extending from said head, said body comprises a relief cut formed therein.

16. A fastening apparatus in accordance with claim 9 wherein said aft fastener comprises a cooling air channel extending therethrough.

17. A fastening apparatus in accordance with claim 9 wherein said aft fastener comprises a ceramic coating.

* * * * *